US008469489B2

(12) United States Patent
Seki et al.

(10) Patent No.: US 8,469,489 B2
(45) Date of Patent: Jun. 25, 2013

(54) INKJET PRINT HEAD AND METHOD THEREFOR

(75) Inventors: Masashi Seki, Shizuoka-ken (JP); Ryutaro Kusunoki, Shizuoka-ken (JP); Chiaki Tanuma, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 417 days.

(21) Appl. No.: 12/689,199

(22) Filed: Jan. 18, 2010

(65) Prior Publication Data

US 2010/0245475 A1 Sep. 30, 2010

(30) Foreign Application Priority Data

Jan. 21, 2009 (JP) ..... 2009-10602
Jun. 23, 2009 (JP) ..... 2009-148355

(51) Int. Cl.
*B41J 2/14* (2006.01)
*B41J 2/045* (2006.01)

(52) U.S. Cl.
USPC ..... 347/45; 347/68; 347/69

(58) Field of Classification Search
USPC ..... 347/68, 69
See application file for complete search history.

(56) References Cited

FOREIGN PATENT DOCUMENTS

JP 2002-160364 6/2002

OTHER PUBLICATIONS

JP2002-160364 machine translation, JPO website.*

* cited by examiner

*Primary Examiner* — Matthew Luu
*Assistant Examiner* — Renee I Wilson
(74) *Attorney, Agent, or Firm* — Patterson & Sheridan, LLP

(57) ABSTRACT

An inkjet print head is fabricated by forming an electrode and two protection film layers composed of an inorganic insulating film and an organic insulating film over the electrode within a groove of a piezoelectric member, adhering a top board to the piezoelectric member covering the groove to form a pressure chamber, adhering a polyimide plate to cover the groove, and then forming a nozzle in the polyimide plate by the excimer laser processing aligning to the pressure chamber. The excimer laser light penetrates the polyimide plate to form a nozzle is then emitted on the organic insulating film. Consequently, part of the organic insulating film is damaged by the laser light. To prevent this damage, the thickness of the inorganic insulating film in the part to which the excimer laser light is emitted is prepared to be 0.5 μm or more.

5 Claims, 7 Drawing Sheets

(a) RF magnetron sputtering method (b) Ion plating method (c) Ion-beam sputtering method (d) CVD method

INKJET PRINT HEAD AND METHOD THEREFOR

CROSS REFERENCE TO RELATED APPLICATION

This application is based upon and claims the benefit of priority from the prior Japanese Patent Applications No. 2009-10602 filed on Jan. 21, 2009 and No. 2009-148355 filed on Jun. 23, 2009, the contents of which are incorporated herein by reference.

BACKGROUND OF THE INVENTION

1. Field of the Invention

The present invention relates to an inkjet print head forming an image by ejecting ink droplets and a method of manufacturing the inkjet print head. The invention particularly relates to an inkjet head having an insulating film within a pressure chamber from which an ink droplet is ejected.

2. Description of the Related Art

JP laid-open application publication No. 2002-160364 describes a so-called shear-mode inkjet print head that ejects an ink droplet from a nozzle using shear-mode deformation of a piezoelectric material. FIG. 8 is a sectional view of an inkjet print head of this type.

This publication describes a structure of an inkjet print head in an ink chamber of which a protection film is deposited to protect an electrode. This inkjet print head is comprised of a piezoelectric ceramic plate in which multiple grooves 117 and sidewalls 118 are formed with electrodes 119 being formed on sidewalls 118 of the internal surface of groove 117, an ink chamber plate covering the grooves to form ink chambers, and a nozzle plate in which multiple nozzles have previously been formed. There is deposited protection layer 120 on the internal groove 117 coating electrodes 119. The protection layer 120 consists of a inorganic insulating film 121 formed of an inorganic material and an organic insulating film 122 formed of an organic material, the former layer being formed first and deposited by the latter. Inorganic insulating layer 121, which is of silicon dioxide ($SiO_2$), is formed in a thickness of 0.5 μm or more. As organic insulating layer 122, monochloroparaxylene is used, and the organic insulating layer is formed in a thickness of 5 μm or more.

In the process of fabricating the print head, after joining the ink chamber plate and ceramic piezoelectric plate in which electrodes 119 are formed, protection layer 120 is deposited. Then, the nozzle plate in which nozzles were previously formed is adhered to the ends of the joined plates.

To enhance positioning accuracy of nozzles with respect to the ink chambers, another process of fabricating the print head is practiced. That is, first, a ceramic piezoelectric plate in which a plurality of grooves, sidewalls, and electrodes on the internal surfaces of the sidewalls are formed, and an ink chamber plate covering the grooves thereby to form ink chambers are joined; a polyimide plate in which any nozzles are not formed yet is adhered to the formerly joined plates; then, nozzles are formed by the excimer laser processing being aligned with the respective ink chambers. In this fabricating process, the positional accuracy relative to each ink chamber can be enhanced compared to the process that a nozzle plate in which nozzles were previously formed is adhered to the joined plates.

The above-mentioned publication also describes an ink jet print head, to prevent deterioration of the electrodes by ink, which uses a ceramic piezoelectric plate in which electrodes are provided on the sidewalls on internal surfaces of grooves and the protection films formed of inorganic insulating film and an organic insulating film for protecting the electrodes are deposited over the electrodes. Herein, a nozzle plate with nozzles having being previously formed is adhered to the ends of the ink chambers. In this process, because of use of an adhesive to adhere the nozzle plate, an adhesive intrudes within the ink chamber, or some adhesive intrudes even into nozzles in some cases transforming the shape of the nozzle. This deformation of the nozzle shape varies the quantity of an ink droplet and its flight direction.

However, in this method of first providing joined plates of a ceramic piezoelectric plate in which electrodes and the protection films are deposited within the groves and the ink chamber plate covering the grooves to form the ink chambers, adhering a polyimide plate not having nozzles to the previously provided joined plates, and thereafter forming nozzles by the excimer laser processing aligning the nozzles to the respective ink chambers, a problem occurs that the protecting film damages.

SUMMARY OF THE INVENTION

Accordingly, it is an aspect of the present invention to provide an inkjet print head that, while being suitable to use with electrically conductive ink, such as an aqueous ink, improves the accuracy of landing position of ink droplets on a recording medium and reduces defective ink ejections.

To accomplish the above object, there is provided an inkjet print head having a nozzle plate in which a plurality of nozzles from which ink is ejected are formed, a plurality of grooves each composing a pressure chamber communicating with a respective nozzle, pressure generating parts each causing ink within the respective pressure chamber to be ejected from the associated nozzle, a top board covering the grooves so as to form the individual pressure chambers, an ink supplying port supplying ink to the pressure chambers, and electrodes formed on the internal surfaces of the respective pressure chambers of the pressure generating parts for supplying a drive pulse to the respective pressure generating parts, the inkjet print head comprising:

a first protecting film composed of an inorganic insulating material formed on the electrode; and a second protecting film composed of an organic insulating material deposited on the first protecting film, second protecting film having a hole formed in the proximity of the nozzle, wherein a thickness of the first protecting film in a position where the hole is formed is 0.5 μm or more.

BRIEF DESCRIPTION OF THE DRAWINGS

These and other objects and advantages of this invention will become apparent and more readily appreciated from the following detailed description of the presently preferred exemplary embodiments of the invention taken in conjunction with the accompanying drawings wherein.

DETAILED DESCRIPTION OF THE INVENTION

Figure 1:
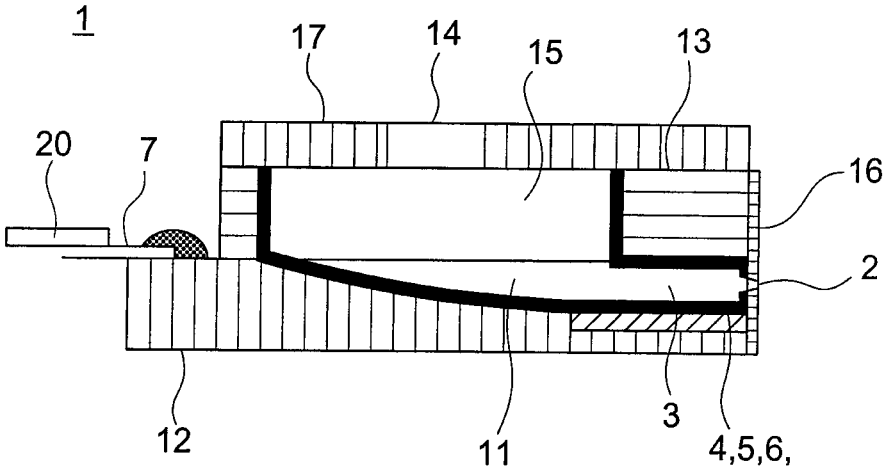
FIG. 1 is a longitudinal sectional view of an inkjet print head fabricated by the manufacturing method according to the present invention.

Preferred embodiments of the present invention will now be described in more detail with reference to the accompanying drawings. However, the same numerals are applied to the similar elements in the drawings, and therefore, the detailed descriptions thereof are not repeated.

A description will be made below how a protecting film is damaged. An excimer laser beam having penetrated a polyimide plate immediately strikes a protecting film that is deposited on internal walls of grooves. As a result, the protecting film is damaged in the portion that was exposed on the laser beam. The protecting film is composed of two layers of an inorganic insulating film and an organic insulating film, which are formed in this order. Thus, a hole is made in a part of the outer organic insulating film exposed on the excimer laser by being evaporated. As a result, that part where the organic insulating film was lost degrades in its insulation.

A nozzle is formed at the nearly midpoint of the depth of an ink chamber. The deposition method as described in the afore-mentioned publication becomes difficult in depositing an inorganic insulating film of 0.5 μm or more in thickness in apart exposed on the laser light as a ratio of a depth of an ink chamber to its width, i.e., an "aspect ratio," increases. The inventors in this application have discovered a method, other than the dipping method or electron beam deposition method, of forming such a film of 0.5 μm or more in thickness in the part exposed on the laser light.

A thin inorganic insulating film makes insufficient resistance against a laser light thereby to decrease the insulation between ink and the electrodes. Where electrically conductive ink, such as an aqueous ink, is used, electrolysis in the ink likely occurs due to low insulation in a part exposed on the laser light, changing characteristics of ink or producing a gas within the ink chamber. These phenomena cause degradation in print performance of the inkjet print head or even disable ink ejection in the worst case.

Figure 2:
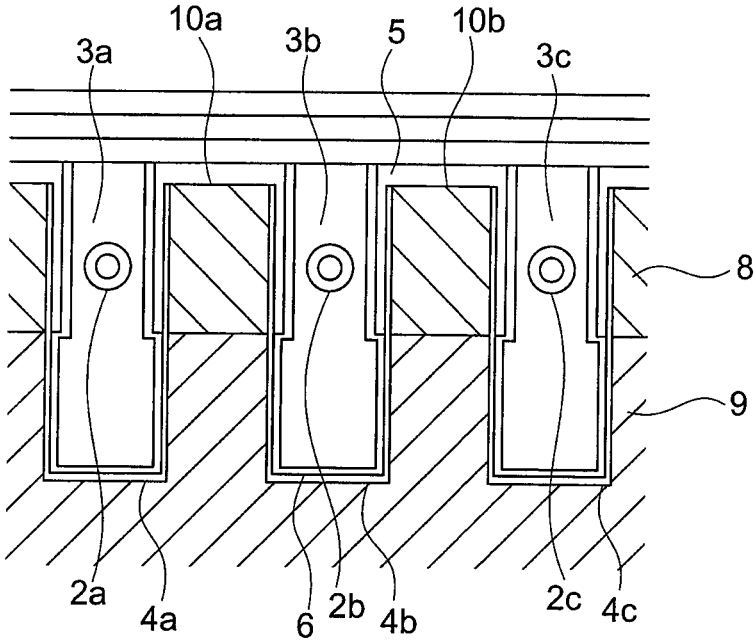
FIG. 2 is a cross-section view of the inkjet print head fabricated by the manufacturing method according to the present invention.

Now, the structure and operations of an inkjet print head will be described according to an embodiment of the present invention. FIGS. 1 and 2 are sectional views of an inkjet print head 1.

Inkjet print head 1 is composed of a substrate 12, a top-board frame 13, a top-board lid 17, and a nozzle plate 16. In the substrate 12, there are formed multiple longi-grooves 11 in parallel. On the internal surface of each longi-groove 11 is formed an electrode each being electrically independent from other and connected to a flat flex-cable 7 through the upper surface of substrate 12. Flat flex-cable 7 is then connected to a drive circuit 20 that generates a drive pulse to drive the inkjet print head.

A first protecting film 5 of an inorganic insulating material and a second protecting film 6 of an organic insulating material are deposited on the surface of electrode 4 (4*a*, 4*b*, 4*c* in FIG. 2) sequentially in this order. The respective longi-grooves 11 are hermitically-closed by top-board frame 13. A part surrounded by longi-groove 11 and top-board frame 13 forms a pressure chamber 3 (3*a*, 3*b*, 3*c* in FIG. 2). Adjacent pressure chambers 3 are partitioned by a sidewall 10 (10*a*, 10*b* in FIG. 2) composed of piezoelectric members (PZT) 8, 9, which are polarized in mutually opposed directions and work as actuators deforming in a shear mode by pulses applied to the related electrodes. A nozzle plate 16 is provided at the end of pressure chamber 3 and each pressure chamber 3 communicates with external ambient air through a nozzle 2 formed in nozzle plate 16. Ink is supplied from an ink supply port 14 formed in top-board lid 17 sequentially to a common pressure chamber 15, longi-groove 11, pressure chamber 3 and nozzle 2. When drive pulses are supplied by drive circuit 20, potential difference are created between electrodes 4*a* and 4*c*, and 4*b*, and the respective electric fields are produced within sidewall 10*a* and sidewall 10*b*. This electric field causes deformation of the both sidewalls in a shear mode so that a pressure of the ink within pressure chamber 3*b* is changed thereby to eject the ink from nozzle 2*b*. When electrically conductive ink is used, since the ink and electrode 4 are electrically insulated from each other by the first and second protecting films, corrosion of the electrode 4, electrolyzation of the ink, and aggregation of dispersing elements within the ink, such as pigments, caused by electric current flow within the ink are prevented.

AS a material for substrate 12, alminum oxide ($Al_2O_3$), silicon nitride ($Si_3N_4$), silicon carbide (SiC), aluminum nitride (AlN), lead zirconate titanate (PZT), etc. may be used. In view of a dielectric constant and a difference between the substrate and piezoelectric members (PZT) 8, 9 with respect to a thermal expansion coefficient, a PZT having a low dielectric constant is used. Included in piezoelectric members (PZT) 8, 9 are lead zirconate titanate (PZT: $Pb(Zr, Ti)O_3$), lithium niobate ($LiNbO_3$), lithium tantalite ($LiTaO_3$), etc. In this embodiment, a PZT having a higher piezoelectric constant is used.

Electrode 4 is formed by two layers of nickel (Ni) and gold (Au). To form a uniform coating in the internal part of the longi-groove, electrode 4 is formed using the plating method. The plating was carried out by masking the necessary internal parts of longi-grooves to make electrically independent electrodes 4. As an alternative methods of forming electrode 4, sputtering method and deposition method may be used. The longi-grooves are formed to be 300 μm in depth and 80 μm in width, and arranged in parallel in an interval of 169 μm.

Nozzle plate 16 is a polyimide film having a thickness of 50 μm, in which nozzles 2 corresponding to the number of the longi-grooves are formed by an excimer laser device. Each of the nozzles is 30 μm in bore diameter on the ink ejection side and 50 μm in bore diameter on the pressure chamber side, forming an inverse tapered opening narrowing towards the ink ejection side. Nozzle 2 formed in nozzle plate 16 is formed towards the top-board frame deviating from the center of longi-groove 11 in its depth direction. Although depending on a method of forming the coating of the inorganic insulating material, inorganic insulating material protecting film 5 is likely to be formed from the opening of longi-groove 11 mainly in the upper part of sidewall 10 in its depth direction. By providing nozzle 2 at a position towards the top-board frame rather than at the center area of longi-groove 11 in its depth direction, even if the organic insulating film formed over the inorganic insulating film is damaged being evaporated by the excimer laser during the process of forming nozzles, the insulation between ink and the electrodes can be maintained.

A ratio of the depth of longi-groove 11 to the width thereof (depth/width) is called "aspect ratio." The deeper the depth is and the narrower the width is, the higher the aspect ratio becomes.

The method of fabricating inkjet print head 1 will be described below.

Embodiment 1

Figure 3:
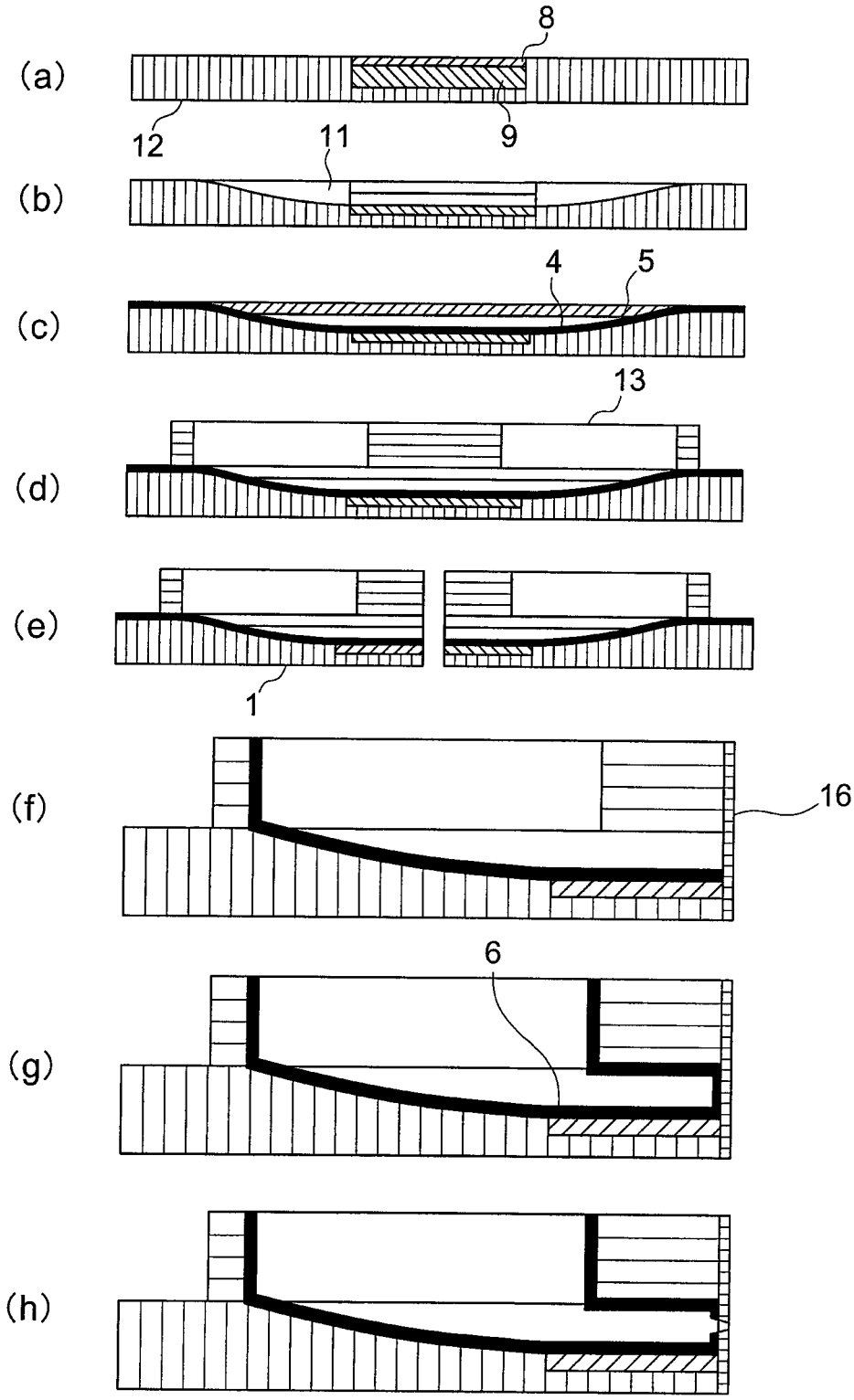
FIG. 3 is a longitudinal sectional view illustrating a process of the manufacturing method in a first embodiment of the present invention.

Shown in FIG. 3 are cross-section views illustrating the process of fabricating inkjet print head 1 in the first embodiment. FIGS. 3(*a*) to 3 (*h*) show the sequence of the fabrication process.

FIG. 3 (*a*) shows a preparation stage of substrate 12. Two piezoelectric members (PZT) 8, 9, which are polarized so that the respective polarization directions oppose each other, are adhered together, and the joined members are embedded into substrate 12 and adhered to it. For substrate 12, a PZT having a lower dielectric constant than those of piezoelectric members (PZT) 8, 9, as described earlier, is used.

FIG. 3 (*b*) shows a process of forming longi-groove 11. Substrate 12 prepared as shown in FIG. 3 (*a*) is grooved by cutting work by a diamond cutter so as to form multiple grooves 11 in parallel with the end surface of substrate 12 traversing piezoelectric members (PZT) 8, 9 in a constant interval. The width of the longi-groove became 80 μm due to the use of a diamond cutter having a blade width of 80 μm. The depth of the longi-groove 11 is determined by the feed amount of the cutter blade in the depth direction. In this embodiment, the depth is determined to be 300 μm. The pitch between the longi-grooves is 169 μm. Therefore, the aspect ratio is 300/80=3.75. The aspect ratio and the pitch of longi-groove 11 are determined to appropriate values depending on an image resolution and a quantity of ink ejection required to individual inkjet print heads.

FIG. 3 (*c*) shows processes of forming electrode 4 and first protecting film 5. An electrode pattern is formed on the surface of substrate 12 and internal surface of longi-groove 11 by means of the electroless nickel plating (electroless Ni plating), and then the electrolytic Au plating is applied over the nickel plating. Subsequently, the $SiO_2$ film having a film thickness of 0.5 μm or more is deposited in longi-groove 11 as a first protecting film 5 composed of an inorganic insulating material.

The $SiO_2$ film was prepared by the radio frequency magnetron sputtering method, and the thickness of the $SiO_2$ film is 0.5 μm or more. During this film forming process, a connection part extended from electrode 4 on the upper surface of substrate 12 is masked to avoid deposition of the $SiO_2$ film over the connection between flat flex-cable 7 and electrode 4.

Usable inorganic insulating materials for the first protecting film 5 are $Al_2O_3$, $SiO_2$, ZnO, MgO, $ZrO_2$, $Ta_2O_5$, $Cr_2O_3$, $TiO_2$, $Y_2O_3$, YBCO, Mullite ($Al_2O_3.SiO_2$), $SrTiO_3$, $Si_3N_4$, ZrN, AlN, Fe304, etc.

The film deposition methods that may be used herein include, besides the radio frequency magnetron sputtering method, ion-beam sputtering method, digital sputtering method, PLD (Pulse Laser Abrasion) method, MBE (Molecular Beam Epitaxy) method, CVD (Chemical Vapor Deposition) method, ALD (Atomic Layer Deposition) method, ion-plating method, etc. Any methods that can have the above-mentioned inorganic insulating material including $SiO_2$ evaporated over the gold-plated electrode by chemical reaction or making the material condensed in vacuum or in the atmosphere may be used.

FIG. 3 (*d*) shows a process of adhering top-board frame 13. Herein, top-board frame 13 is adhered onto the upper surface of substrate 12.

FIG. 3(*e*) shows a process of cutting out the member shown in FIG. 3(*d*). Substrate 12 is divided into two inkjet print heads 1 by a cutting work.

FIG. 3(*f*) shows a process of adhering a polyimide film. Herein, a polyimide film composing nozzle plate 16 is adhered to the sides of pressure chamber 3. When the polyimide film is adhered to the sides of pressure chamber 3, the adhesive between sidewall 10 and the polyimide film runs off into pressure chamber 3 by the polyimide film being pushed towards sidewall 10. The run-off adhesive is hardened forming a thin film inside the polyimide film on the pressure chamber side. The bond uses an epoxy resin.

FIG. 3(*g*) shows a process for deposition of an organic insulating film. Herein, a film of a Parylene resin (polyparaxylene) of organic insulating material 6 having a film thickness of 3 μm or more is deposited in the longi-grooves as the second protecting film. The end portions providing the connections between electrodes 4 and the respective flat flex-cables 7 are masked to avoid Parylene to be adhered thereto. Since Parylene is easily adhered to a material, it can be likely adhered to the internal walls of longi-grooves 11 through the opening of top-board frame 13.

Now, a description will be made for a process for deposition of Parylene film. A highly reactive radical monomer (diradical paraxylene) is produced by vaporizing a diparaxylene of the basic material and then thermally decomposing it. When this monomer is adsorbed to the first protecting film or the gold-plated electrode, then polymerization occurs to produce a polymer film (Parylene film).

Polyimide may also be used as the inorganic insulating material other than Parylene.

As depicted in FIGS. 3(*e*) and 3(*f*), Parylene as shown in FIG. 3(*g*) is formed following the division into two inkjet print heads 1 and adhesion of top-board frame 13 to substrate 12. When the division is made into the two inkjet print heads 1 as depicted in FIG. 3 (*e*), the adjacent portion of the cut surface of longi-groove 11 sometimes appears rough. Even in this case, since Parylene film is formed after the adhesion of the polyimide film, a sufficient inorganic insulating film can be formed in the area around the boundary between longi-groove 11 and the polyimide film, as shown in FIG. 3(*g*).

FIG. 3 (*h*) shows a process of forming nozzle 2. An inverse tapered nozzle is formed in a polyimide film by the excimer laser process. The inverse tapered shape in nozzle 2 means a nozzle whose bore on pressure chamber 3 side is shaped larger than one on the ink-ejection port side. The position of nozzle to be processed by the excimer laser process is off-centered in the depth direction of the pressure chamber towards the opening of top-board frame 13. In the excimer process, the polyimide film is irradiated by excimer laser from the opposite side of pressure chamber 3 with respect to the polyimide film to chemically decompose the polyimide to form a nozzle. By setting the focusing point of the excimer laser off the surface of the polyimide film, the laser light spreads so that an inverse tapered shape with a narrow bore on the ink-ejection port side and a wider bore on the chamber side is formed.

Figure 4:
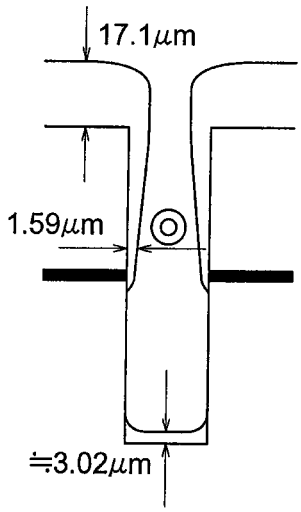
FIG. 4 is a cross-section view of the inkjet print head in which a first protecting film prepared by the deposition method in the first embodiment.
Figure 4:
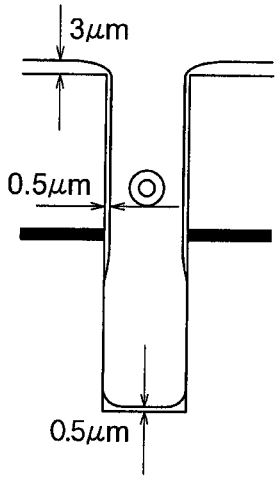
Figure 4:
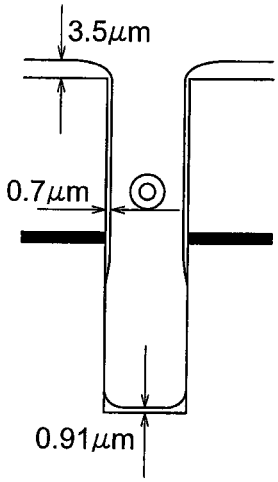
Figure 4:
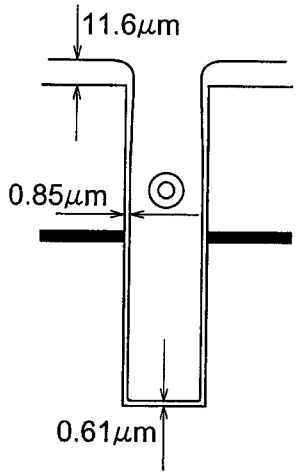

FIG. 4 shows an observation result with respect to the deposit property of the first protecting film 5 as an inorganic insulating film when the film formation was processed using a substrate having an aspect ratio of 4 that is a ratio of the width to the depth of the pressure chamber.

The first protecting film 5 of an inorganic insulating film was prepared by the RF magnetron sputtering method, ion-plating method, ion-beam sputtering method, and CVD method.

In these methods, it was confirmed that, when the film formation was performed aiming at 3 to 20 μm of the film thickness, deposition of the first protecting film 5 of an inorganic insulating film of 0.5 μm thick could be achieved from the opening of the pressure chamber up to the midpoint in the depth of the longi-groove.

Figure 5:
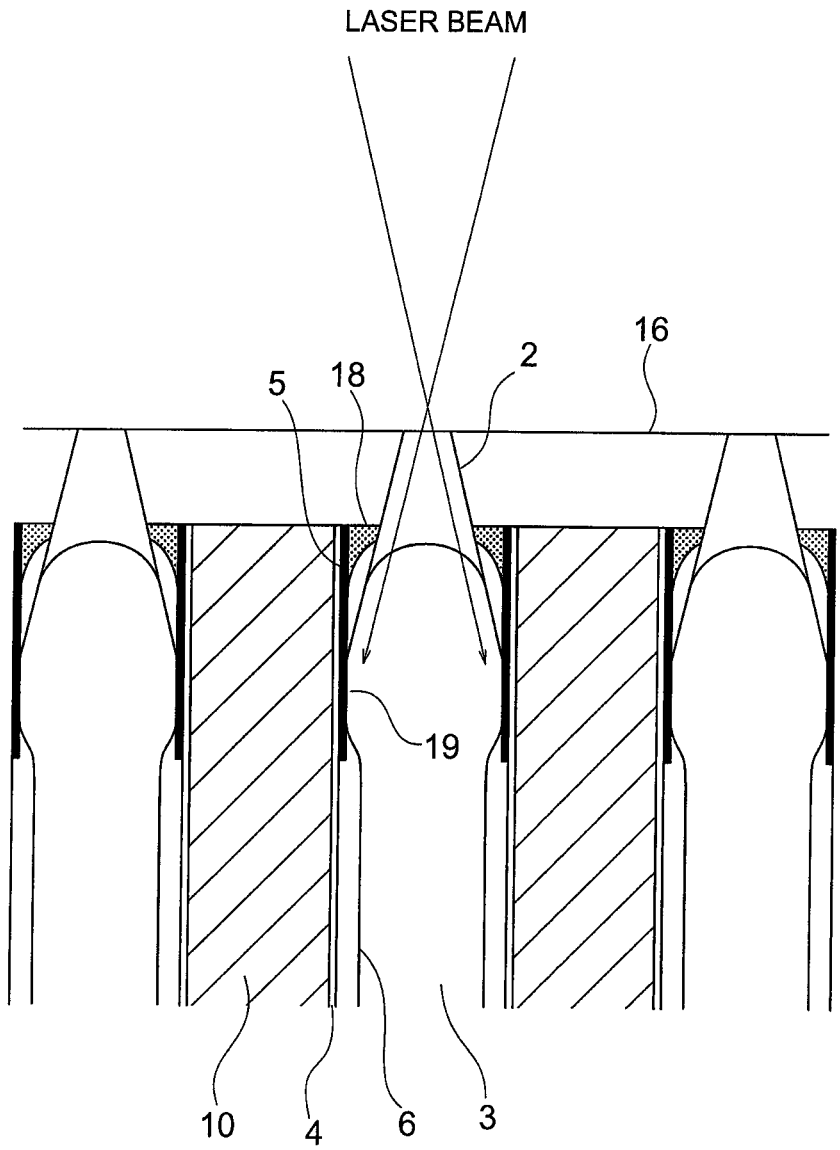
FIG. 5 is a sectional view of a principal part of the inkjet print head fabricated by the manufacturing method in the first embodiment.

Referring to FIG. 5, a description will be made for making nozzles by laser beam machining using the substrate to which the first protecting film 5 of an inorganic insulating film having 0.5 μm in thickness has been achieved at least up to the half of the longi-groove 11 in depth.

FIG. 5 is a detailed cross sectional view of the peripheral of nozzle 2, where nozzle 2 was formed by making an inverse tapered hole on a polyimide film by the excimer laser process.

Adhesive 18 that has run off during the process of adhering the polyimide film to the side of pressure chamber 3 is removed when nozzle 2 is formed by the excimer laser process. At the same time when sidewall 10 is radiated by the excimer laser, the organic insulating film of second protecting film 6 is also partially removed. This hole is called a laser-damaged hole 19 because it is created by the laser process. The hole created in the organic insulating film means a state of a dent on the surface of the organic insulating film produced by an occurrence of metamorphism, fusing, evaporation, sublimation, etc. of the organic substance, or a state of loss of the insulating film as much as the insulating film is exposed. Even when laser-damaged hole 19 is created, the thickness of the first protecting film 5 of an inorganic insulating film holds 0.5 μm or more in the position of laser-damaged hole 19, and therefore, the first protecting film 5 cannot receive the laser damage by the radiation of the laser light.

By thus suppressing the laser damage, even when a conductive aqueous ink is introduced within pressure chamber 3, the insulation between electrode 4 and the ink can be electrically maintained. Thus, corrosion of electrode 4 and electrolyzation of the ink can be prevented.

Because first protecting film 5 is made of an inorganic insulating material, it is difficult to totally prevent an occurrence of pinholes within the material. However, since first protecting film 5 is protected by second protecting film 6 in the rest of the area other than laser-damaged hole 19, the possibility of impairing the insulation due to the pinholes is low.

Figure 6:
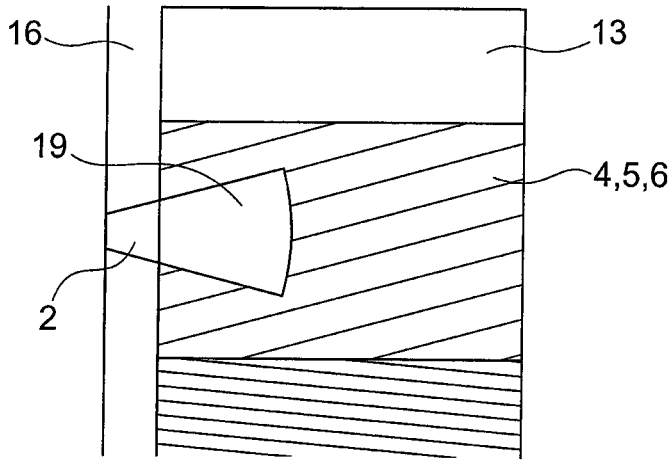
FIG. 6 is a cross section view of the inkjet print head in which first and second protecting films prepared by the deposition method in the first embodiment.

FIG. 6 illustrates a state of the laser damage in the inkjet print head having second protecting film 6 of an organic insulating material and first protecting film 5 of an inorganic insulating material. First, excimer laser light forms nozzle 2 through nozzle plate 16. After the formation of nozzle 2 by excimer laser light, electrode 4, first protecting film 5, and second protecting film 6 that are provided on inner walls of pressure chamber 3 are radiated with the excimer laser light, and as a result laser-damaged hole 19 is produced in second protecting film 6 in the proximity of the nozzle. Since the excimer laser light incomes to the pressure chamber from the side of the nozzle plate, the laser-damaged hole is formed on the nozzle plate side in the ink-ejection direction within the pressure chamber. The size of laser-damaged hole varies depending on the intensity of the excimer laser light and the taper angle of the nozzle.

The composition of first protecting film 5 in the spot of the laser-damaged hole was analyzed, wherein first protecting film 5 was deposited in a film thickness of 1.0 μm by the RF magnetron sputtering method.

As a result, chloride (Cl) and carbon (C) that compose Parylene of the organic insulating material of the second protecting film were not detected in the spot of laser-damaged hole 19. This revealed that laser-damaged hole 19 was made with second protecting film 6 removed therein.

On the other hand, silicon (Si) and oxide (O) that compose $SiO_2$ of the inorganic insulating material of the first protecting film were detected in the spot of laser-damaged hole 19. This indicates that a laser-damaged hole was not created in the first protecting film even when the protecting film was irradiated with the excimer laser light.

Experiments were also made using various methods including the RF magnetron sputtering method, to form first protecting film 5 having a film thickness in the range of 0.5 to 3 μm, and the composition in the laser damage hole in each case was analyzed. The analysis results have exhibited the same result as in the preceding case.

From the above, it became clear that, if the thickness of first protecting film 5 is 0.5 μm or more, the resistance to the laser light can be maintained.

If the thickness of first protecting film 5 holds 0.5 μm or more, the insulation between the ink and electrode 4 can be maintained. However, if the thickness of first protecting film 5 exceeds 3 μm, the amount of ink ejection is reduced due to the narrowed width of the pressure chamber. In addition, provision of the thicker coating suppresses movement of the piezoelectric member due to the increased stiffness of $SiO_2$, thereby reducing the amount of the ink ejection. Therefore, it is more preferable that the thickness of first protecting film 5 is between 0.5 μm and 3.0 μm.

On the other hand, if the thickness of second protecting film 6 of an organic insulating film is 3 μm or more, the insulation between the ink and electrode 4 can be maintained. If the thickness of second protecting film 6 exceeds 5 μm, the substantial capacity of the pressure chamber is reduced due to preparation of a Parylene film all over the inner walls of the pressure chamber, thereby reducing the amount of ink ejection. Accordingly, it is preferable that the thickness of second protecting film 6 is 3 μm or more, and less than 5 μm. To maintain the insulation between the ink and electrodes and secure a desired amount of ink ejection, the total thickness of the first and second coatings needs to be less than 6 μm.

Second Embodiment

Now, a description will be made for the second embodiment.

Figure 7:
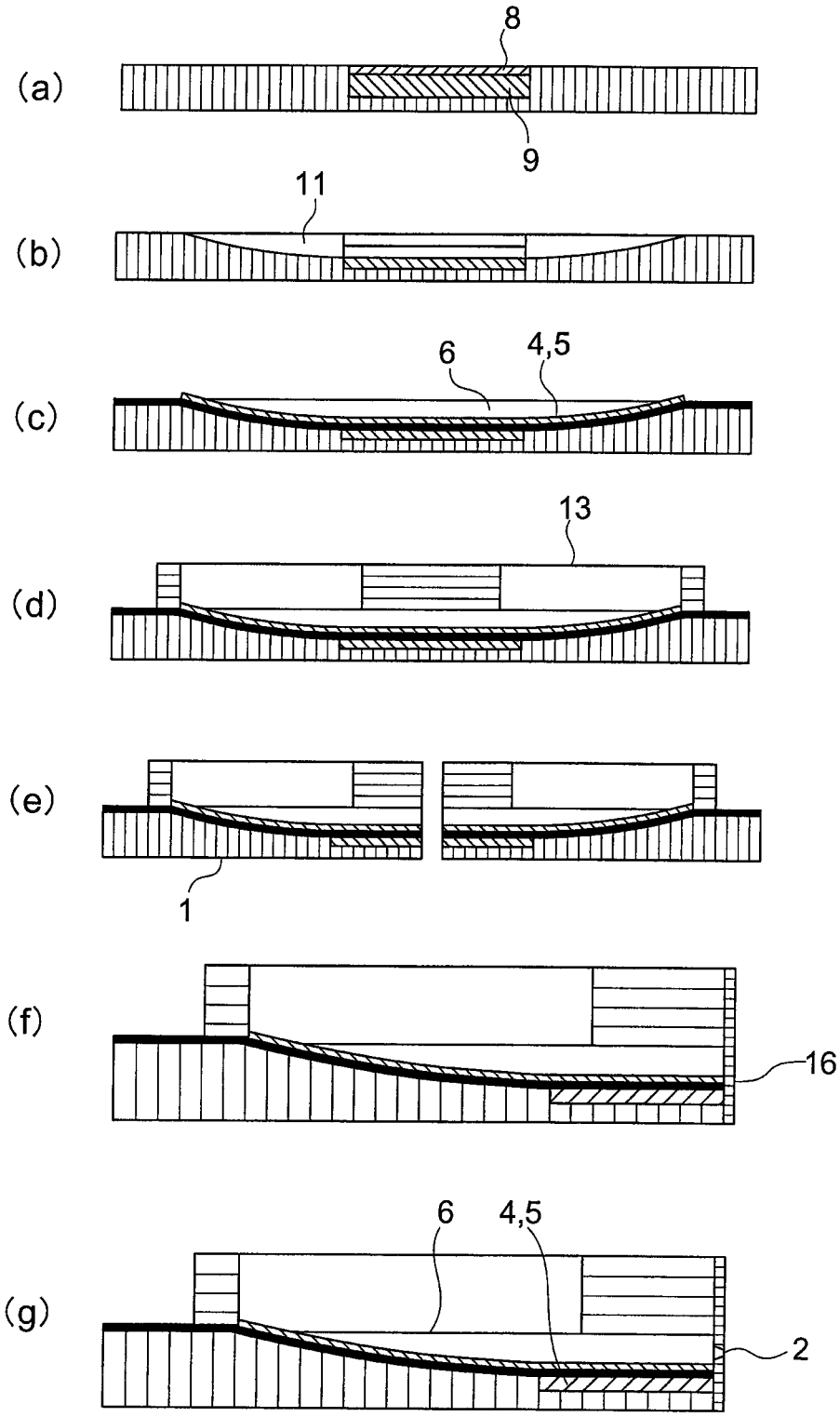
FIG. 7 is a longitudinal sectional view illustrating a process of the manufacturing method in a second embodiment of the present invention.
Figure 8:
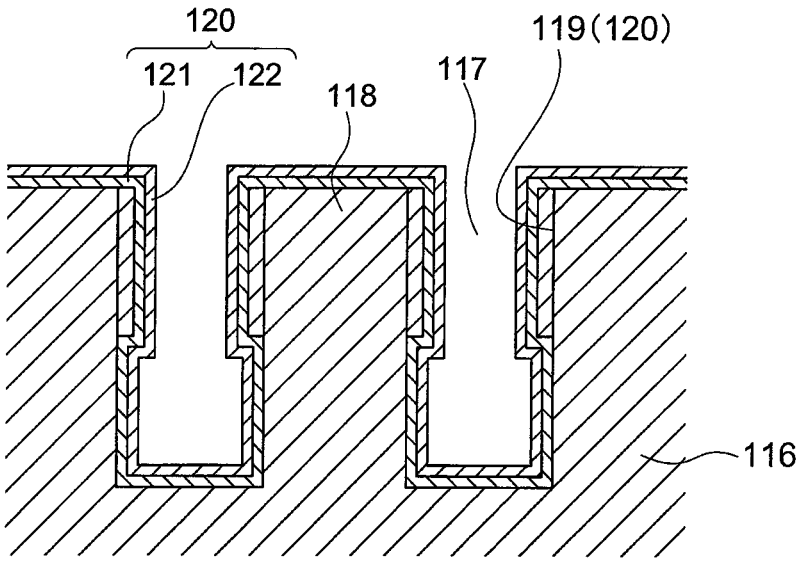
FIG. 8 is an exploded perspective view of an inkjet print head in the related art.

FIG. 7(*a*) shows a process of preparing substrate 12. Two piezoelectric members (PZT) 8, 9, which are polarized so that the respective polarization directions oppose each other, are adhered together, and the adhered members are embedded into substrate 12. As described earlier, substrate 12 uses a PZT having a lower dielectric constant than those of piezoelectric members (PZT) 8, 9.

FIG. 7(*b*) shows a process of forming longi-groove 11. Multiple longi-grooves 11 having a certain interval are formed by cutting work by a diamond cutter in parallel with the end surface of substrate 12 traversing piezoelectric members (PZT) 8, 9.

FIG. 7(*c*) shows a process of forming electrode 4, first protecting film 5, and second protecting film 6. An electrode pattern is formed on the surface of a substrate and internal surface of longi-groove 11 by means of the electroless nickel plating, and then the Au plating is applied over the electrode. Subsequently, a film of $SiO_2$ having a thickness of 0.5 μm or more is formed within longi-groove 11 as first protecting film 5 composed of an inorganic insulating material. Successively, a film of a Parylene resin (polyparaxylene) of an organic insulating material having a thickness of 3 μm or more is deposited in the longi-grooves as the second protecting film. The formation of the film of Parylene was carried out in the same manner as in the first embodiment.

FIG. 7 (*d*) shows a process of adhering top-board frame 13. Herein, top-board frame 13 is adhered onto the upper surface of substrate 12.

FIG. 7(*e*) shows a process of cutting the member formed in reference to FIG. 3(*d*). Substrate 12 is divided into two inkjet print heads 1 by a cutting work.

FIG. 7(*f*) shows a process of adhering a polyimide film by an epoxy adhesive bond. The polyimide film to compose a nozzle plate 16 is adhered to the side of pressure chamber 3 by an epoxy adhesive bond.

FIG. 7(*g*) shows a process of forming nozzles 2. Nozzles each in an inverse tapered shape are formed in a polyimide film by the excimer laser processing to form nozzle plate 16. The formation of the nozzles was processed in the same conditions as described in the first embodiment.

In the second embodiment also, since the thickness of first protecting film 5 in the spot of laser-damaged hole 19 shown in FIG. 5 is 0.5 μm or more, a laser-damaged hole was not produced in first protecting film 5 even if the protecting film was irradiated with the laser light. Therefore, even when a conductive ink is injected into pressure chamber 3, the electrical insulation between the electrode 4 and the ink is maintained. Accordingly, corrosion of electrode 4 and electrolysis of the ink can be prevented.

As described in the first embodiment, it became seen that the resistance to the laser light is maintained if the thickness of first protecting film 5 is 0.5 μm or more.

The thickness of the inorganic insulating film and organic insulating film are the same as in the first embodiment.

If the thickness of first protecting film 5 of an inorganic insulating film is 0.5 μm or more, the insulation between the ink and electrodes 4 can be maintained. However, the thickness of first protecting film 5 exceeds 3 μm, the amount of ink ejection becomes reduced due to the reduction of the narrowed width of the pressure chamber. In addition, provision of the thicker coating suppresses the movement of the piezoelectric member by increased stiffness of $SiO_2$, thereby reducing the amount of the ink ejection. Therefore, it is preferable that the thickness of first protecting film 5 does not exceed 3.0 μm. It is more preferable that the thickness is 0.5 μm or more, and 3.0 μm or less.

If the thickness of second protecting film 6 of an organic insulating film is 3 μm or more, the insulation between the ink and electrode 4 can be maintained. If second protecting film 6 exceeds 5 μm, the substantial capacity of the pressure chamber is reduced due to formation of a Parylene film all over the inner walls of the pressure chamber, thereby reducing the amount of ink ejection. Therefore, it is preferable that the thickness of second protecting film 6 is 3 μm or more and less than 5 μm. To maintain the insulation between the ink and electrodes and secure a desired amount of ink ejection, the total thickness of the first and second coatings needs to be less than 6 μm.

The inkjet print heads fabricated by the method of manufacturing an inkjet print head are suitable for use with electrically conductive inks such as an aqueous ink. Besides, because of the reduction of defective ink ejections, the print heads can be used as an inkjet print head for industrial printing.

Numerous modifications and variations of the present invention are possible in light of the above teachings. It is therefore to be understood that, within the scope of the appended claims, the present invention can be practiced in a manner other than as specifically described therein.

What is claimed is:

1. An inkjet print head having a plurality of grooves each comprising a pressure chamber, a nozzle plate comprising a plurality of nozzles formed by a laser process, the nozzle plate covering an opening of each of the pressure chambers and each pressure chamber communicating with a respective nozzle, a plurality of pressure generating parts each causing ink within the respective pressure chamber to be ejected from the associated nozzle, a top board covering the grooves so as to form the individual pressure chambers, an ink supplying port supplying ink to the pressure chambers, and a plurality of electrodes each formed on an internal surface of each of the respective pressure chambers for supplying a drive pulse to the respective pressure generating parts, the inkjet print head comprising:

a first protecting film comprised of an inorganic insulating material having a predetermined thickness partially formed on each electrode; and a second protecting film comprised of an organic insulating material formed on the first protecting film and on a portion of the electrode which is not covered by the first protecting film, the second protecting film having a plurality of laser-damaged holes in which the organic insulating material has been partially removed when the nozzles were formed by the laser process, the laser-damaged holes exposing a portion of the first protecting film, wherein the first protecting film has an area larger than the laser damaged hole.

2. The inkjet print head according to claim 1, wherein a position of the laser-damaged hole is off a center of the pressure chamber towards the nozzle in an ink flow direction within the pressure chamber.

3. The inkjet print head according to claim 1, wherein the first protecting film is comprised of a material selected from the group consisting of $Al_2O_3$, $SiO_2$, ZnO, MgO, $ZrO_2$, $Ta_2O_5$, $Cr_2O_3$, $TiO_2$, $Y_2O_3$, YBCO, Mullite ($Al_2O_3SiO_2$), $SrTiO_3$, $Si_3N_4$, ZrN, AlN, and $Fe_3O_4$.

4. The inkjet print head according to claim 1, wherein the second protecting film is comprised of a material selected from the group consisting of Parylene-C, Parylene-N, Parylene-D, Parylene-HR, Parylene-SR, and polyimide.

5. The inkjet print head according to claim 1, wherein the first protecting film is formed by one of: digital sputtering method, PLD method, AP-CVD method, PE-CVD method, and ALD (Atomic Layer Deposition) method.

* * * * *